US012722825B2

(12) United States Patent
Paez et al.

(10) Patent No.: US 12,722,825 B2
(45) Date of Patent: Sep. 1, 2026

(54) RETRACTABLE TANK LOADING DEVICE AND ITS USE

(71) Applicant: DYNAMIC AIR LTDA, Sao Paulo (BR)

(72) Inventors: Horacio N. Paez, Sao Paulo (BR); Gregory J. Steele, Saint Paul, MN (US)

(73) Assignee: DYNAMIC AIR LTDA, Sao Paulo (BR)

( * ) Notice: Subject to any disclaimer, the term of this patent is extended or adjusted under 35 U.S.C. 154(b) by 0 days.

(21) Appl. No.: 19/098,114

(22) Filed: Apr. 2, 2025

(65) Prior Publication Data

US 2025/0313368 A1 Oct. 9, 2025

(30) Foreign Application Priority Data

Apr. 4, 2024 (BR) ..... 1020240066197

(51) Int. Cl.
*B65B 39/02* (2006.01)
*B65B 1/04* (2006.01)
*B65B 1/28* (2006.01)

(52) U.S. Cl.
CPC ..... *B65B 39/02* (2013.01); *B65B 1/04* (2013.01); *B65B 1/28* (2013.01)

(58) Field of Classification Search
CPC .. B65B 1/04; B65B 1/28; B65B 39/00; B65B 39/02
See application file for complete search history.

(56) References Cited

U.S. PATENT DOCUMENTS 4,703,782 A * 11/1987 Henkel, Sr. ..... B65B 39/04 141/286
4,727,913 A * 3/1988 Bliss ..... B65G 69/182 141/93
4,821,861 A * 4/1989 Shanahan ..... B65G 11/083 193/25 E
5,016,686 A * 5/1991 Gerstenkorn ..... B65G 69/181 141/96
5,154,271 A * 10/1992 Binzen ..... B65G 69/181 193/30
5,622,291 A * 4/1997 Semenenko ..... B65G 69/183 141/264
5,845,686 A * 12/1998 Okumura ..... B65G 69/181 141/231
6,019,147 A * 2/2000 Prescott ..... B65G 69/181 141/263
6,569,217 B1 * 5/2003 DeMarco ..... B01D 50/20 96/380
7,690,494 B2 * 4/2010 Rillmann ..... B65G 11/146 193/30
9,694,995 B2 * 7/2017 Haraway ..... B65G 69/188
2021/0371146 A1 * 12/2021 Schroer ..... B65B 1/32

* cited by examiner

*Primary Examiner* — Nicolas A Arnett
(74) *Attorney, Agent, or Firm* — Morgan, Lewis & Bockius LLP

(57) ABSTRACT

The present invention relates to a retractable device for loading particles of material into a tank, the device comprising: a hopper, a pulley, and a sleeve connected to the pulley. The hopper is configured to receive particles of material and to direct the received particles into the sleeve. The sleeve is configured to carry the particles of material received from the hopper into the tank. The length of the sleeve inside the tank is adjustable by rotating the pulley.

9 Claims, 5 Drawing Sheets

RETRACTABLE TANK LOADING DEVICE AND ITS USE

TECHNICAL FIELD

The present invention relates to the field of tank loading in general. Specifically, the present invention is related to a retractable device for loading materials into a tank.

BACKGROUND ART

Tanks are commonly used for the storage and transportation of products in general. Depending on the application, tanks, usually made of metal or composite material, can serve, for example, as silos, reactors, and pneumatic conveyors.

The simplest way to fill a tank is simply to allow particles of a material positioned above an upper opening of the tank to fall inside it. However, depending on the type of material to be loaded into the tank, this technique is inappropriate. The impact between particles of falling material and the interior of the tank, or between falling particles and particles that already partially fill the interior of the tank, can lead to material degradation. This may result in loss of the value of the material, reduced material effectiveness (e.g., a catalyst material may have its catalytic effect diminished if degraded), and dust generation, which can be particularly problematic if the material is toxic or explosive.

To remedy this issue, the use of sleeves is known in the state of the art. The sleeves are essentially flexible hoses, usually made of woven material. They are positioned at the upper opening of the tank, extending through the interior of the tank. Particles of material to be loaded into the tank are inserted into the upper opening of the sleeve, which reduces the falling speed of such particles, allowing them to reach the interior of the tank more gently.

However, using sleeves presents a problem. As the interior of the tank fills up, the lower opening of the sleeve (at the end located inside the tank) will at some point be blocked, preventing new particles of material from entering. At this point, the sleeve will be fully filled, creating a column of high weight. Since the weight of the sleeve prevents it from being lifted to reopen its lower part and allow new particles to enter, it is known in the state of the art to keep a person inside the tank to cut sections of the sleeve whenever its outlet is blocked. Such an operation, in addition to being ineffective, is dangerous, especially for loading toxic or explosive material.

SUMMARY OF THE INVENTION

The present invention relates to a retractable device for loading particles of material into a tank, the device comprising: a hopper; a pulley; and a sleeve connected to the pulley. The hopper is configured to receive the material particles and direct the received particles into the sleeve. The sleeve is configured to carry the material particles received from the hopper into the tank. The length of the sleeve inside the tank is adjustable by rotating the pulley.

Optionally, the hopper has a conical bottom shape.

Optionally, the pulley is rotated by a rotating means.

Optionally, the rotating means is a crank or an electric motor.

Optionally, the hopper, the pulley, the sleeve, and the rotating means are mounted on a skid.

Optionally, the sleeve is configured to be wound onto the pulley in a strip shape and to be extended towards the interior of the tank in a hose shape. The hose shape is formed from a lower part of the hopper into the tank.

Optionally, the hose shape is formed by joining the two sides of the sleeve with a removable fastening means.

Optionally, the removable fastening means is Velcro.

Optionally, the removable fastening means is configured to undo the joining of the two sides of the sleeve, at the lower part of the hopper, by means of a retraction action of the sleeve on the pulley.

Optionally, the sleeve is made of woven material.

The present invention also relates to the use of the device as described above for loading a tank.

The present invention further relates to a method for loading particles of material into a tank, comprising the steps of: unwinding the pulley to position a lower opening of the sleeve inside the tank; receiving the material particles in the hopper; directing the received material particles from the hopper into the sleeve; directing the received material particles from inside the sleeve into the tank; and winding the pulley and adjusting the positioning of the sleeve's lower opening as the interior of the tank is filled with the material particles.

DETAILED DESCRIPTION

Figure 1:
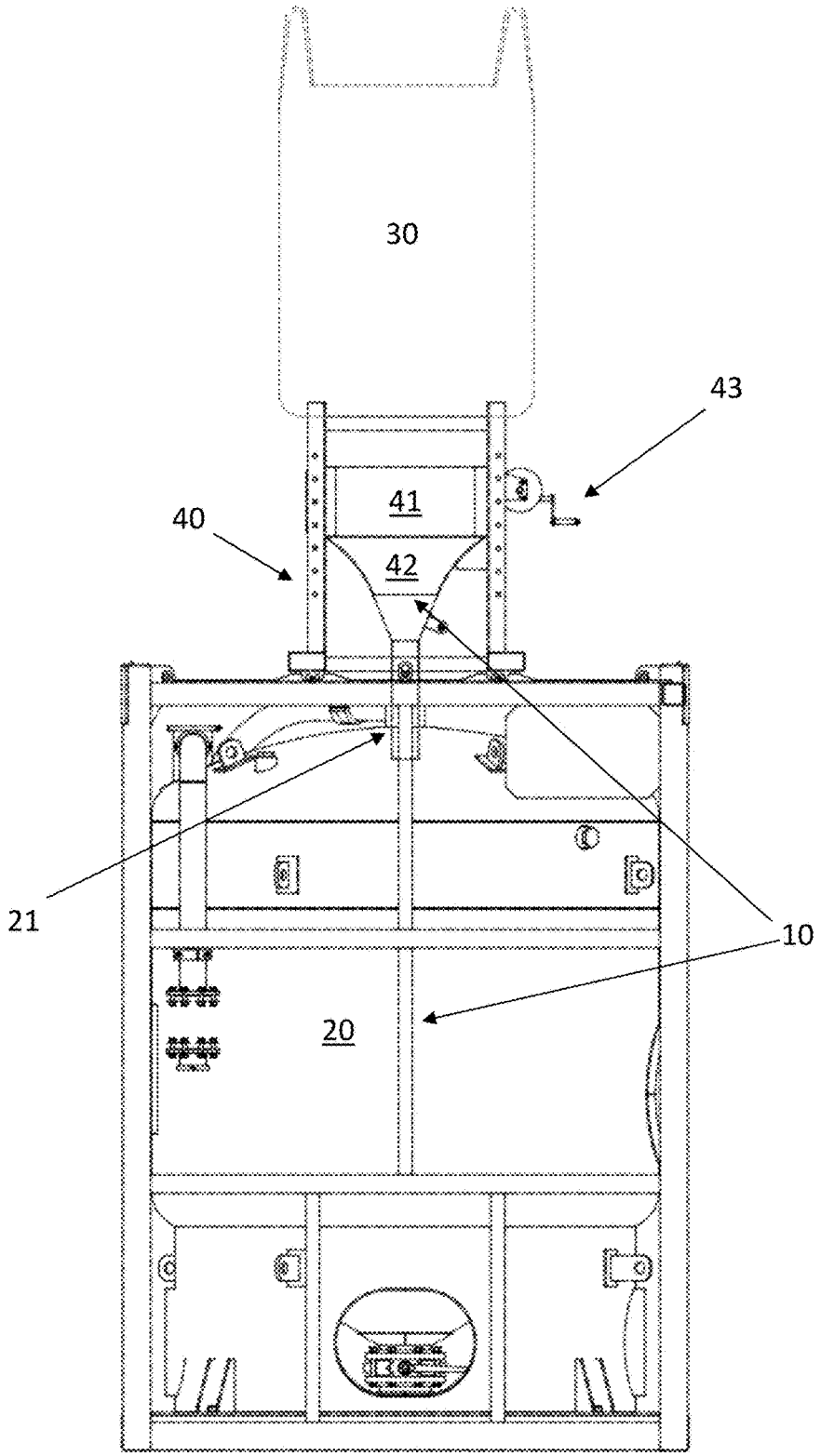
FIG. 1 illustrates an example embodiment of the device according to the present invention.

FIG. 1 illustrates an example embodiment of the retractable loading device of the present invention, comprising a hopper 42, a pulley 41, and a sleeve 10, which length inside a tank is adjustable by the rotation of the pulley 41.

A bag 30, commonly known in the prior art as big bag, comprises particles of material to be loaded into a tank 20. The bag 30 is positioned above a skid 40, typically by a crane (not shown). The skid 40, in turn, is positioned above the tank 20 and preferably comprises, in addition to its own chassis, the pulley 41, and the hopper 42.

Figure 2:
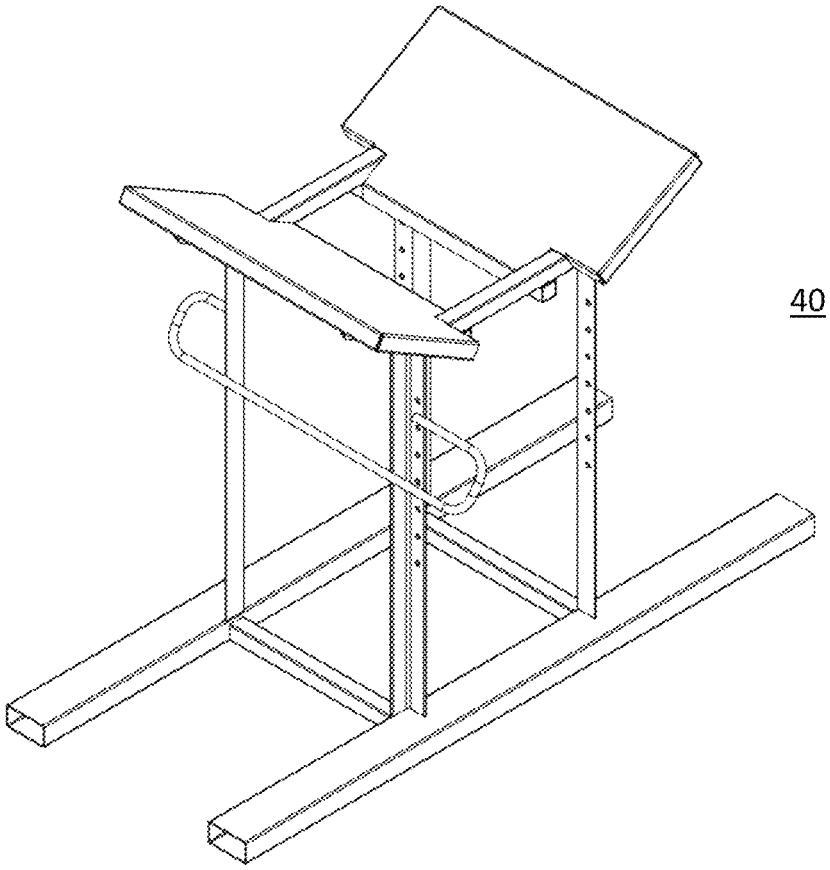
FIG. 2 illustrates the skid used in the embodiment of FIG. 1.
Figure 3:
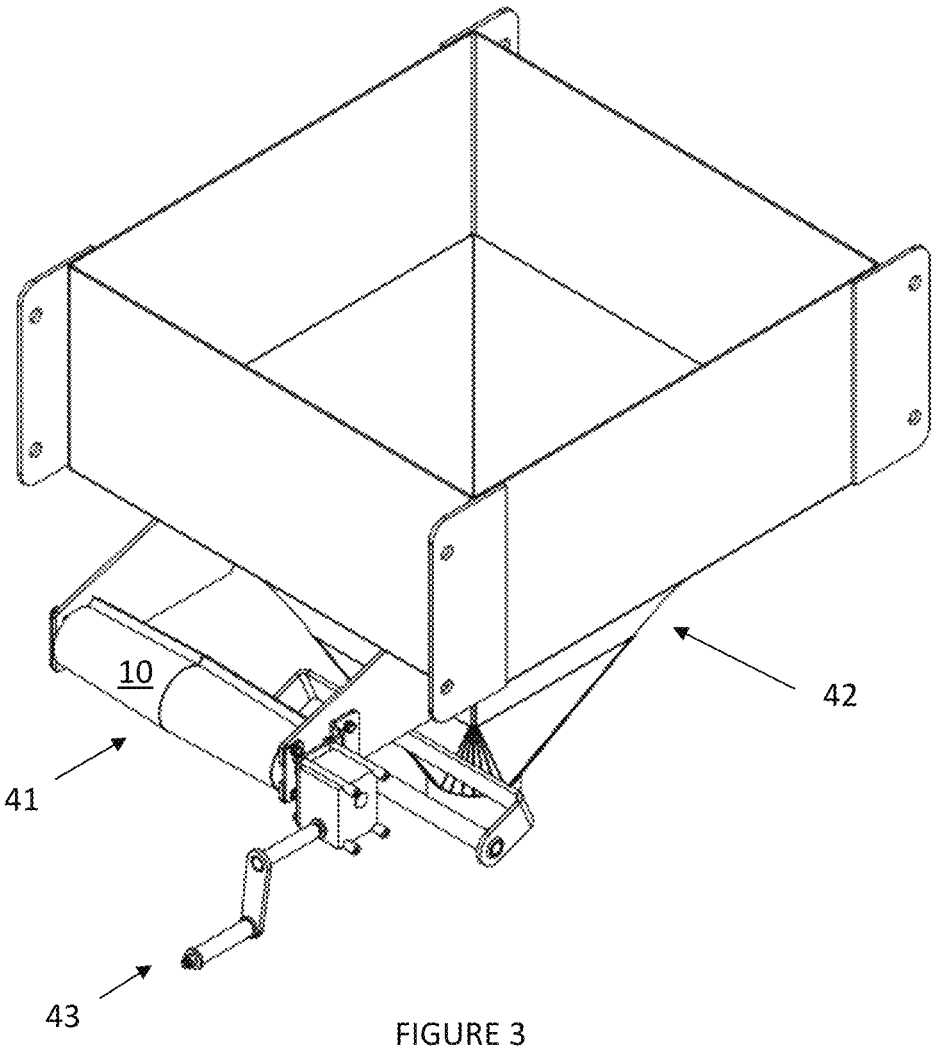
FIG. 3 illustrates the hopper and the sleeve wound on the pulley of the embodiment of FIG. 1.

FIG. 2 shows a perspective view of the chassis of the skid 40. FIG. 3 shows a perspective view of the pulley 41 and the hopper 42, which, in this preferred embodiment of the invention, are mounted on the skid 40. The hopper preferably has a conical bottom shape. In FIG. 3, the sleeve 10 is wound onto the pulley 41, forming a roll that can be unwound using a crank 43.

It should be understood that although a crank 43 is illustrated, any other means to wind/unwind the roll may be employed. An electric motor is mentioned as an example.

Still according to FIG. 1, the roll is unwound. An opening of sleeve 10 is positioned around the lower part of the hopper 42, and another opening of sleeve 10 is positioned, through an upper opening 21 of tank 20, inside the tank 20. For this, in this preferred embodiment of the invention, sleeve 10 is in the form of a long strip of flexible material, preferably woven, whose sides are joined by a removable fastening means to form a hose. The fastening means is preferably Velcro. However, any other means capable of keeping the sides of the sleeve 10 attached and capable of releasing the sides of the sleeve 10 by applying force can be used, such as a zipper. The sleeve 10 is preferably made of nylon.

Figure 4:
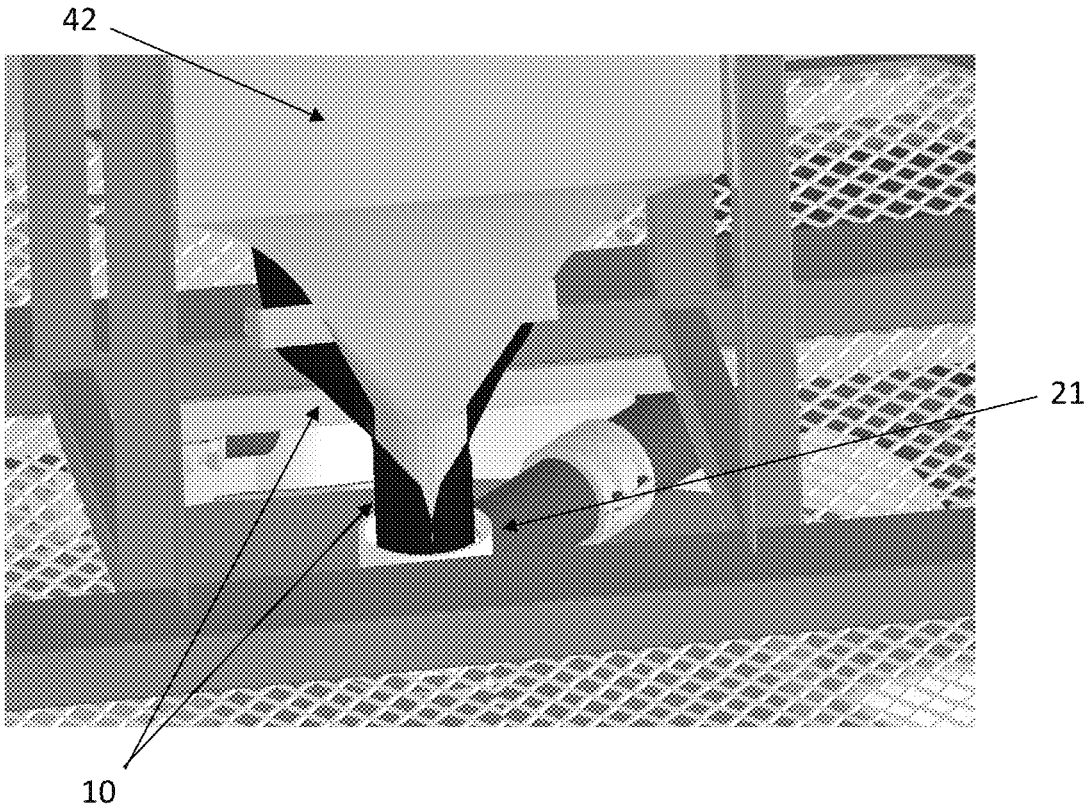
FIG. 4 is a front view of the sleeve unwound and positioned around a lower part of the hopper in the embodiment of FIG. 1.
Figure 5:
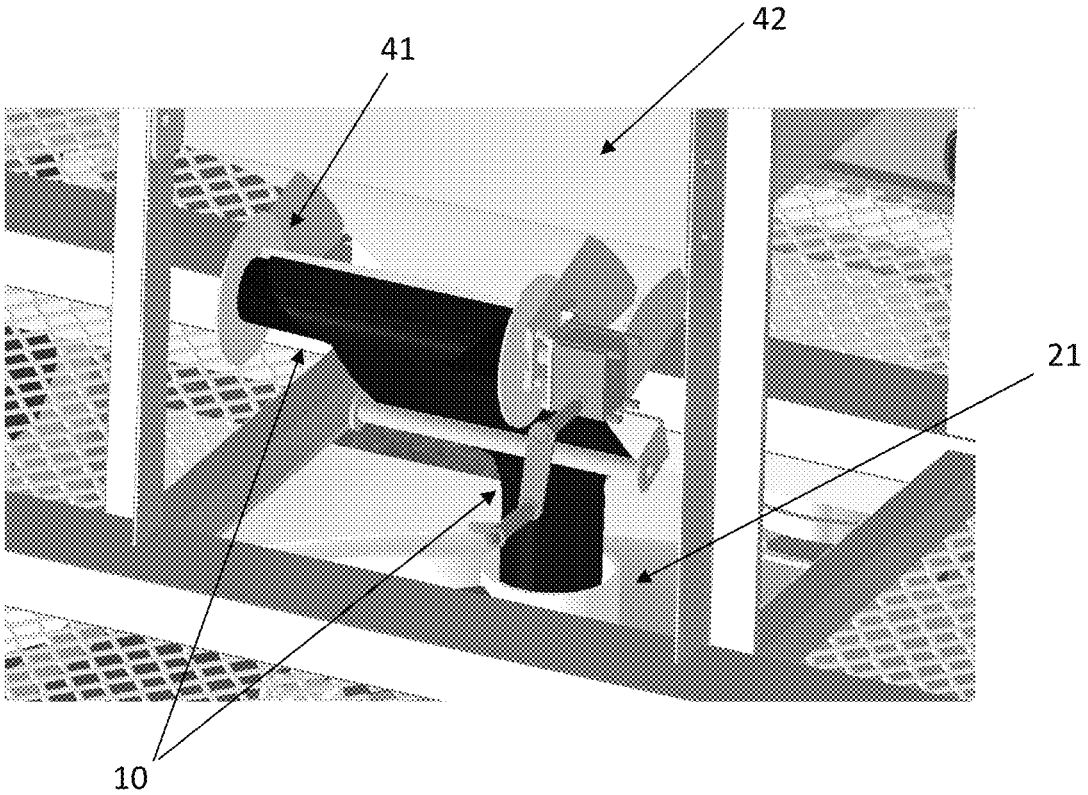
FIG. 5 is a rear view of the sleeve unwound and positioned around a lower part of the hopper in the embodiment of FIG. 1.
Figure 6:
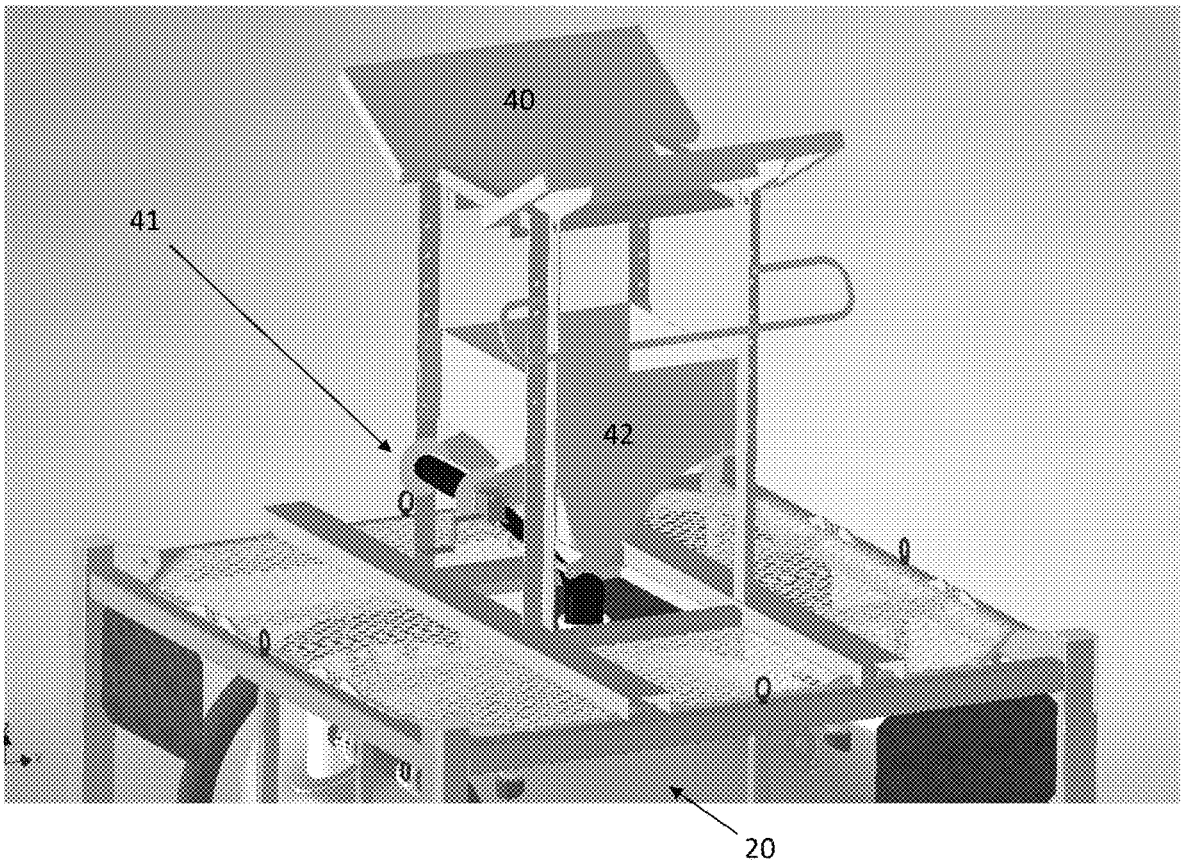
FIG. 6 is a perspective view of FIGS. 4 and 5.

FIGS. 4, 5, and 6 show in detail the positioning of the sleeve 10 around the lower part of the hopper 42. As can be seen, the sleeve 10 is wound, in strip form, on the pulley 41 and surrounds, in hose form, the lower part of the hopper 42, entering the interior of the tank 20 through entry 21.

After positioning sleeve 10 inside tank 20, the tank is ready to be filled. Bag 30 is opened and the particles of material are directed, by gravity, into hopper 42. The hopper 42 directs the particles into the sleeve 10. The sleeve 10, in turn, carries the particles into tank 20. At some point, the particles that reach the interior of the tank 20 will begin to fill the lower surface of the interior of the tank 20, raising the fill level. The fill level will eventually reach the height of the lower opening of the sleeve 10, obstructing the passage of new particles. At this point, crank 43 can be actuated to rotate pulley 41. Rotation of pulley 41 will generate a force applied to sleeve 10 which will undo the fixing of the sides of sleeve 10 made by the removable fastening means at the height of the lower part of the hopper (FIG. 4). This will allow sleeve 10 to be retracted onto pulley 41 and raise the level of its lower opening inside tank 20, allowing new particles to pass through. This operation is repeated until tank 20 is filled.

An advantage of mounting the pulley 41, the hopper 42 and the crank 43, or other equivalent means, on a skid 40, is that this entire assembly can be pre-assembled prior to the filling operation of the tank 20. Like the bag 30, the skid 40 can be lifted and positioned above tank 20, which avoids the assembly of the entire assembly on site.

A tab (not shown) may also be mounted on the lower part of the hopper 42, at the position where the sides of the sleeve 10 are joined around the hopper. The tab will assist in removing the attachment between the sides of the sleeve 10 as the sleeve 10 is retracted onto the pulley 41.

The invention claimed is:

1. A retractable device for loading particles of material into a tank, the device comprising:

a hopper;

a pulley; and a sleeve connected to the pulley, wherein:

the hopper is configured to receive the particles of material and to direct the received particles into the sleeve;

the sleeve is configured to carry the particles of material received from the hopper into the tank;

the length of the sleeve inside the tank is adjustable by rotating the pulley; and the sleeve is configured to be wound on the pulley in a strip form and extended towards the interior of the tank in a hose form, the hose form being created from a lower part of the hopper into the tank.

2. The device of claim 1, wherein the hopper has a conical bottom shape.

3. The device of claim 1, wherein the pulley is configured to be rotated by a rotating device.

4. The device of claim 3, wherein the rotating device is a crank or an electric motor.

5. The device of claim 3, wherein the hopper, the pulley, the sleeve, and the rotating device are mounted on a skid.

6. The device of claim 1, wherein the hose form is made by joining the two sides of the sleeve by a removable fastener.

7. The device of claim 6, wherein the removable fastener is configured to undo the joining of the two sides of the sleeve at the lower part of the hopper by means of a retraction of the sleeve on the pulley.

8. The device of claim 1, wherein the sleeve is made of woven material.

9. A method for loading particles of material into a tank by means of the device of claim 1, the method comprising the steps of:

unwinding the pulley to position a lower opening of the sleeve inside the tank;

receiving the particles of material in the hopper;

directing the particles of material received from the hopper into the sleeve;

directing the particles of material received from inside the sleeve into the tank; and winding the pulley and adjusting the positioning of the lower opening of the sleeve as the interior of the tank is filled with the particles of material.

* * * * *